United States Patent [19]

Nelson et al.

[11] 4,116,340

[45] Sep. 26, 1978

[54] GAME EQUIPMENT HOLDER

[76] Inventors: Marvin H. Nelson, 4600 Sierra Wood La., Pleasanton; Georgia R. Minshall, 11577 Ladera Ct., Dublin, both of Calif. 94566

[21] Appl. No.: 744,886

[22] Filed: Nov. 24, 1976

[51] Int. Cl.[2] ..... A47F 7/00

[52] U.S. Cl. ..... 211/13; 211/49 R; D6/125

[58] Field of Search ..... 211/13, 50, 60–69.9, 211/14, 49; 248/108–111, 37.3, 37.6; D6/114, 125; D34/55 T; 206/315

[56] References Cited

U.S. PATENT DOCUMENTS

| | | | |
|---|---|---|---|
| D. 191,709 | 11/1961 | Schock | D6/114 |
| D. 236,052 | 7/1975 | Trieschmann | D6/125 |
| D. 238,735 | 2/1976 | Trieschmann | D6/125 |
| D. 240,876 | 8/1976 | Learing | D6/114 |
| 559,655 | 5/1896 | Zaring | 211/49 R |
| 1,602,020 | 10/1926 | Wheeler | 211/49 R |
| 2,621,807 | 12/1952 | Rendich | 211/49 R |

FOREIGN PATENT DOCUMENTS

| | | | |
|---|---|---|---|
| 1,239,493 | 7/1960 | France | 248/37.3 |
| 927,240 | 5/1963 | United Kingdom. | |

*Primary Examiner*—William H. Schultz
*Assistant Examiner*—Terrell P. Lewis
*Attorney, Agent, or Firm*—Bielen and Peterson

[57] ABSTRACT

A holder for game equipment including rackets utilizing a backing means which may be a movably mountable body. First, second, third and fourth members fix to the backing means and extend outward from the backing means. The first member is higher than the second member and extends between at least two rackets which generally criss-cross and bearing on the first member. The first and third members as well as the first and fourth members form a channel narrower than the head of the rackets being supported such that the rackets do not slip downwardly and out from the members.

5 Claims, 3 Drawing Figures

GAME EQUIPMENT HOLDER

BACKGROUND OF THE INVENTION

The present invention relates to a novel game equipment holder. Competitive sports such as tennis, squash, pingpong, badminton, rackets, and the like employ a racket or paddle generally having the configuration of an enlarged head portion for hitting an object of play and a gripping handle. The rackets used in these games or sports are often very valuable and sometimes custom manufactured to the player individual's tastes and athletic attributes. Consequently, great care is required in the storage of the same, but access for immediate play is also desired. As is the case, with weapons such as rifles, archery equipment and the like, persons often take pride in displaying game equipment in a tasteful and pleasing fashion.

Prior equipment for storing and for displaying racket type game equipment has entailed merely placing a nait or crockery hook into a vacant wall or closet which wastes much space and does not meet the aesthetic standard of many persons. A method or apparatus for efficiently and agreeably storing sports equipment is needed.

SUMMARY OF THE INVENTION

In accordance with the present invention a novel and useful game equipment holder is provided. The holder employes a backing means which may in its simplest form, be a wall, but may also take the form of a separate body mountable on a wall or edifice. The backing means present a surface for the fixing of a first and second member which extend outwardly from the backing means. The second member positions lower than the first member on the backing means. A first game racket would then rest one side of the racket handle on the second member as would the other side of the racket handle of a second game racket. The first member would extend between the two rackets above the crossing area of the two racket handles. Each of the members may take the form of a pin, peg, hook or any like protrusion.

A third member and a fourth member both fixed to the backing means, horizontally space from the second member. The upper first member and third member form a channel narrower than the widest dimension of the head of the first racket. Similarly, the upper first member and the fourth member form a channel to wedge the head of the second racket. The third and fourth members lie on either side of an imaginary line along the surface of the backing means connecting the first and second members. Further, the third and fourth members may be vertically positioned between the upper first and lower second members and equidistant from the imaginary line between the first and second members.

The position of the rackets on the equipment holder permits the placement of a canister, containing such items as tennis balls, ping-pong balls, and the like, between the downwardly and outwardly extending handles. Such placement may include the provision of a fifth member fixed to the backing means to upwardly support the canister. A sixth and seventh member again affixed to the backing means form a channel, wider than a selected dimension of the canister. The resulting arrangement the fifth, sixth, and seventh members, holds a canister on the backing means permitting free access to the canister for use. In addition, the first, second, third and fourth members support a multiplicity of rackets in alternating criss-cross fashion for instant removal and use.

The equipment holder heretofore described may be constructed of any material and in any size variation commesurate with this specification.

It is therefore an object of the present invention to provide a novel equipment holder for neatly and efficiently holding racket type equipment.

It is another object of the present invention to provide a novel equipment holder for supporting racket type equipment aethetically and for quick and easy access for using the same.

It is a further object of the present invention to provide a novel equipment holder which is mountable on a wall surface and readily movable as a unit therefrom.

It is yet another object of the present invention to provide a novel equipment holder or storing a multiplicity of rackets and a canister normally associated with racket type games.

The invention possesses other objects and advantages especially as concerns particular features and characteristics thereof which will become apparent as the specification continues.

Various aspects of the present invention will evolve from the following detailed description of the preferred embodiments thereof which should be taken in conjunction with the accompanying drawings.

BRIEF DESCRIPTION OF THE PREFERRED EMBODIMENTS

DETAILED DESCRIPTION OF THE PREFERRED EMBODIMENTS

Figure 1:
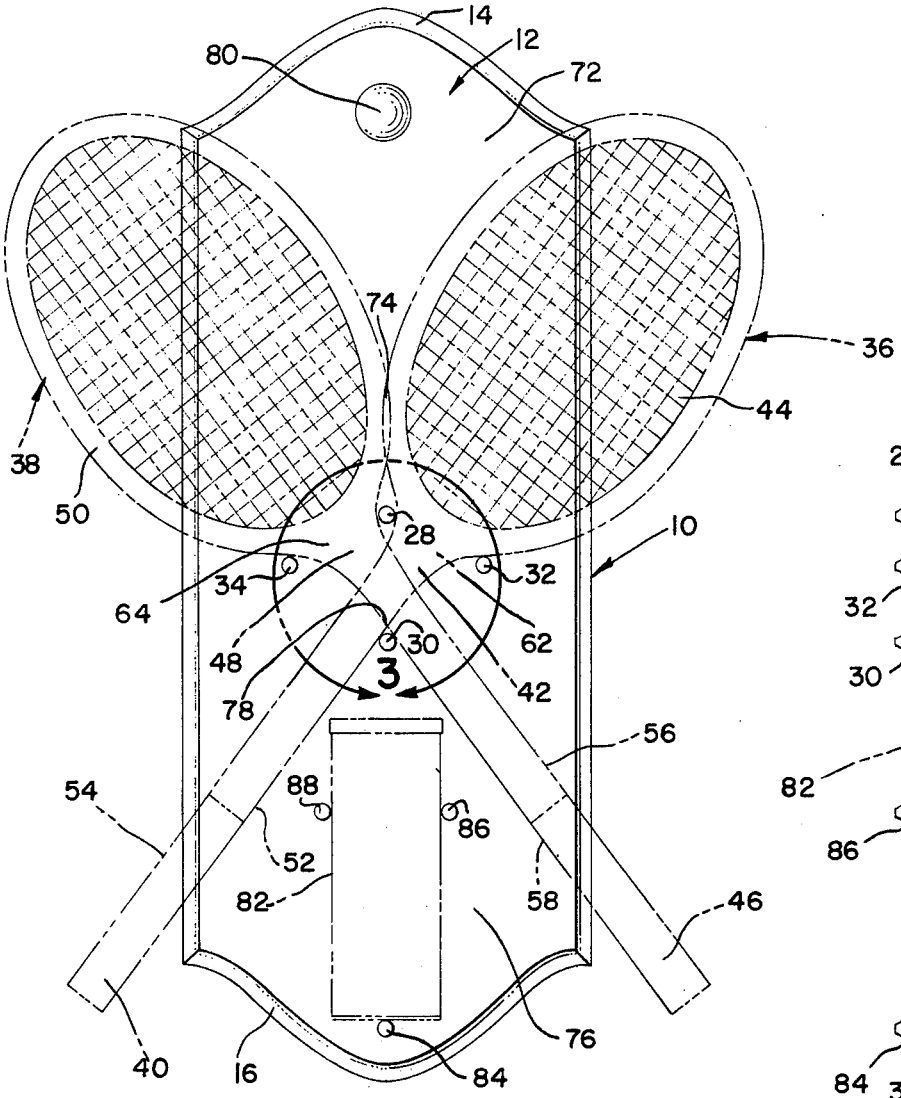
FIG. 1 is a front elevational view of the invention.
Figure 2:
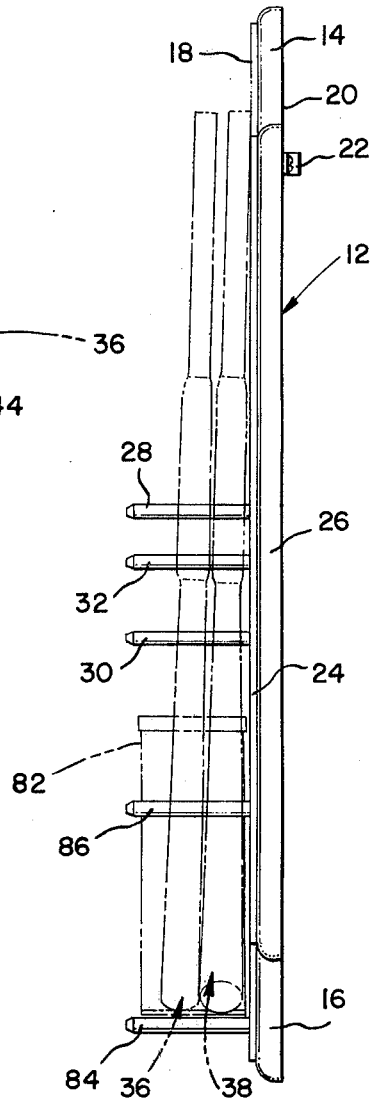
FIG. 2 is a side elevational view of the invention.

The invention as a whole is shown in the drawings and designated by reference character 10. Included as one of its elements is a backing means 12 which may be a wall or partition in its simplest form but, is depicted in FIGS. 1 and 2 as a generally oblong slab having curved end portions 14 and 16 with a curved bevel about the periphery of the slab. The backing means 12 has a first surface 18 and a second surface 20, FIG. 2. Surface 20 may be mounted on a wall or partition in the embodiment shown by employment of bracket 22.

Surface 18 may lie on a raised portion 24 which sits upon a base portion 26 of backing means 12, FIG. 2.

First member 28, second member 30, third member 32 and fourth member 34 form a group of members supporting a first game racket 36 and a second game racket 38. Rackets 38 and 40 may include any type of device having a narrowed section often used as a handle and an enlarged head portion. This category of items may include rackets used to play badminton, racquets, tennis, court tennis, table tennis and the like as well as other articles such as snowshoes. The invention is shown in the drawings with tennis rackets, as exemplar of other types of racket-like objects. Racket 36 includes handle 40, throat 42 and head 44. Likewise racket 38 has handle 46, throat 48 and head 50 as its elements.

Racket 36 may be viewed as disected along the axis of handle 40 to form one side 52 and the other side 54. In an identical manner, racket 38 has one side 56 and the other side 58.

Figure 3:
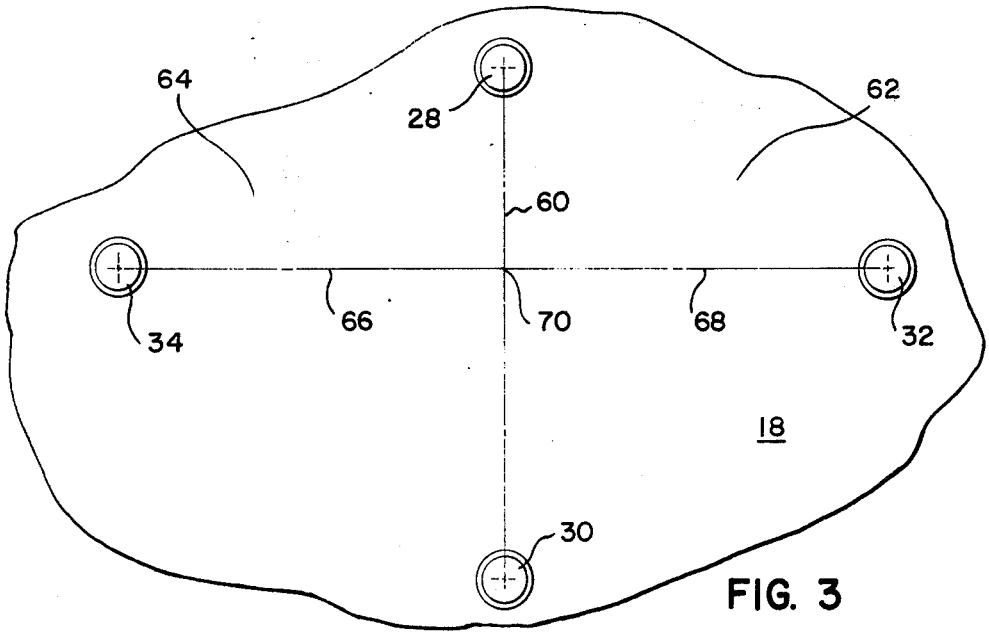
FIG. 3 is a broken front view of a portion of the invention included within the circular arrows of "3" of FIG. 1.

Members 28, 30, 32, and 34 fix to surface 18 and extend outwardly therefrom. First member 28 lies between the throats, 42 and 48, and heads, 44 and 50 of rackets 36 and 38. Members 28, 30, 32 and 34 may take the form of pegs as shown in the drawings but may be any protrusion from surface 18. Second member 30 bears on one side 52 of first racket 36 and the other side 58 of second racket 38. First member 28 is located vertically above second member 30. Third member 32 and fourth member 34 space horizontally from second member 30 on opposite sides of imaginary straight line 60 on surface 18, FIG. 3. Line 60 runs from the point of contact of members 28 and 30, which is represented by the axis of the peg configuration of members 28 and 30.

Third member 32 and first member 28 form channel 62 which is narrower than the widest dimension of the head 44 of racket 36. Thus, the racket 36 wedges between members 32 and 28. Similarly, the racket 38 wedges between fourth and first members 34 and 28 via the channel 64 narrower than head 50 of second racket 38.

Members 32 and 34 bear on one side 52 of first racket 36 and other side 58 of second racket 38 respectively. Depending on the width of surface 18, members 32 and 34 may be higher vertically than first member 28. To present the aesthic effect of having rackets 36 and 38 extend outside the confines of surface 18 of backing means 12, members 32 and 34 position vertically between the height of upper first member 28 and lower second member 32. Further, symmetry obtains when the distance of line 66 equals the distance line 68, FIG. 3. In such a case members 32 and 34 are spaced substantially equidistant from imaginary line 60. Finally a truly symmetrical positioning pattern of rackets 36 and 38 results from spacing members 32 and 34 on an equal level vertically between members 28 and 32, in such a situation line 60 would be bisected at substantially right angles at point by a single line 66, 68.

The criss-cross fashion of mounting rackets 36 and 38 permits a space 72 above the overlapping point 74 of the heads 44 and 50 thereof and a space 76 below the overlapping point 78 of handles 40 and 46. Spaces 72 and 76 may be employed to mount other items such as keys cards and like paraphernalia pertaining to the particular racket game associated with game rackets 36 and 38. Space 72 is depicted in FIG. 1 as having a design 80 superimposed thereon.

Space 76 provides an area for a canister 82, which contains tennis balls in the particular example described herein. Fifth member 84, sixth member 86, and seventh member 88 affix to and extend from surface 18 much in the same manner as members 28, 30, 32, and 34 but extensive variation in shape and size of the members may be deemed equivalent as previously described. Fifth member 84 bears on canister 82. Sixth member 86 and seventh member form a channel 90 wider than the selected dimension of canister 82. This formation of the members permits an upright disposition of canister 82 which does not interfere with the placement, removal, and replacement of rackets 36 and 38.

Members 28, 30, 32, 34, 84, 86, and 88 may be of a length great enough to hold more than two rackets and a single canister.

In operation the holder 10 mounts on a particular surface using bracket 22. Tennis rackets 36 and 38 are mounted between pegs 28 and 32 and 28 and 34 respectively. Heads 44 and 50 wedge within channels 62 and 64 while first side 52 and other side 58 of rackets 36 and 38 rest on member 30. Canister 82 bears on member 84 and fits between members 86 and 88 within channel 90. Rackets 36 and 38, as well as canister 82 remove easily by pulling such outwardly from the backing means 12.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A racket game equipment holder for positioning at least a first and second racket in criss-cross fashion, each of the rackets having one and another sides and compactly positioning a cannister in relation to the rackets comprising:

a. backing means for presenting a surface;

b. a first member fixed to said backing means and extending outwardly therefrom;

c. a second member fixed to said backing means and extending outwardly therefrom, said second member intended for bearing on one side of a first game racket and another side of a second game racket, said second member vertically spaced lower than said first member on said backing means, said first member's extention outwardly from said backing means occuring between the first and second racket;

d. a third member fixed to said backing means and extending outwardly therefrom, said third member horizontally spaced from said second member, said first member and said third member adapted to form a channel narrower than the widest dimension of the head of the first racket;

e. a fourth member fixed to said backing means and extending outwardly therefrom, said fourth member horizontally spaced from said second member, said third member and said fourth member lying on opposite sides of a line on the surface of said backing means connecting the points of contact of said first and fourth member with said backing means, said first and fourth member with said backing means, said first and fourth members adapted to form a channel narrower than the widest dimension of the head of the second racket;

f. a fifth member fixed to said backing means and extending outwardly therefrom, said fifth member intended for bearing on a cannister; and g. a sixth member and seventh member fixed to said backing means and extending outwardly therefrom, said sixth and seventh members forming a channel wider than a selected dimension of the cannister; said fifth, sixth, and seventh members positioned to lie between the racket handles of the first and second rackets to compactly support the cannister substantially between the racket handles, adjacent said backing means.

2. The holder of claim 1 in which said third and fourth members are vertically positioned on said backing means between said upper first member and said lower second member, said third and fourth members spaced substantially equidistant from said line connecting said first and second members.

3. The holder of claim 1 in which said backing means is adapted for mounting on a surface.

4. The holder of claim 3 in which said third and fourth members are vertically positioned on said backing means between said upper first member and said lower second member, said third and fourth members spaced substantially equidistant from said line connecting said first and second members.

5. The holder of claim 2 in which said first, second, third and fourth members are adapted for holding greater than two rackets.

* * * * *